US008266930B2

(12) United States Patent
Jeong et al.

(10) Patent No.: US 8,266,930 B2
(45) Date of Patent: Sep. 18, 2012

(54) LAUNDRY DEVICE

(75) Inventors: Seong Hae Jeong, Changwon-si (KR); Seong Jin Jo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 575 days.

(21) Appl. No.: 12/517,694

(22) PCT Filed: Dec. 31, 2007

(86) PCT No.: PCT/KR2007/007018
§ 371 (c)(1),
(2), (4) Date: Jun. 4, 2009

(87) PCT Pub. No.: WO2008/084932
PCT Pub. Date: Jul. 17, 2008

(65) Prior Publication Data

US 2010/0064736 A1 Mar. 18, 2010

(30) Foreign Application Priority Data

Jan. 10, 2007 (KR) ..... 10-2007-0002818
Jan. 10, 2007 (KR) ..... 10-2007-0002819

(51) Int. Cl.
*D06F 29/00* (2006.01)
*D06F 35/00* (2006.01)
*D06F 31/00* (2006.01)

(52) U.S. Cl. ..... 68/27; 68/13 R

(58) Field of Classification Search ..... 68/13 R, 68/27
See application file for complete search history.

(56) References Cited

U.S. PATENT DOCUMENTS

| | | | | |
|---|---|---|---|---|
| 7,904,983 | B2 * | 3/2011 | Jun et al. | 8/158 |
| 2002/0042957 | A1 * | 4/2002 | Kim et al. | 8/158 |
| 2005/0172678 | A1 | 8/2005 | Kim et al. | |
| 2006/0010934 | A1 | 1/2006 | Kim | |
| 2006/0090524 | A1 | 5/2006 | Jeon et al. | |
| 2006/0112585 | A1 | 6/2006 | Choi et al. | |
| 2006/0156765 | A1 * | 7/2006 | Sunshine et al. | 68/13 R |
| 2007/0151120 | A1 | 7/2007 | Tomasi et al. | |
| 2008/0169034 | A1 * | 7/2008 | Schroeder | 137/624.13 |

FOREIGN PATENT DOCUMENTS

| | | | |
|---|---|---|---|
| CN | 1349012 | A | 5/2002 |
| CN | 1721713 | A | 1/2006 |
| EP | 1029961 | A2 | 8/2000 |

(Continued)

*Primary Examiner* — Michael Barr
*Assistant Examiner* — Charles W Kling
(74) *Attorney, Agent, or Firm* — Birch, Stewart, Kolasch & Birch, LLP

(57) ABSTRACT

A laundry treating machine including a laundry treating device (100) and a pedestal laundry treating device (200) is disclosed. The laundry treating machine is configured to achieve simultaneous or selective supply of water and simultaneous or selective draining of wash water for the laundry treating device (100) and pedestal laundry treating device (200). The pedestal laundry treating device (200) supports the laundry treating device (100) beneath and outside the laundry treating device. The pedestal laundry treating device (200) has a volume and a height smaller than those of the laundry treating device (100), and has a laundry treating function. The laundry treating machine (100) further includes a water supplier (350) for simultaneously or selectively supplying water to the laundry treating device (100) and pedestal laundry treating device (200), and a water drainer (460) for joining wash water discharged from the laundry treating device (100) and wash water discharged from the pedestal laundry treating device (200) into a draining pipe (430), and draining the joined wash water.

19 Claims, 9 Drawing Sheets

FOREIGN PATENT DOCUMENTS

| | | | |
|---|---|---|---|
| EP | 1369523 | A1 | 12/2003 |
| FR | 2289658 | A1 | 5/1976 |
| GB | 1510528 | A | 5/1978 |
| JP | 10-15276 | A | 1/1998 |
| RU | 2317357 | C2 | 8/2004 |
| WO | WO 0212609 | A1 * | 2/2002 |

* cited by examiner

[Fig. 1]
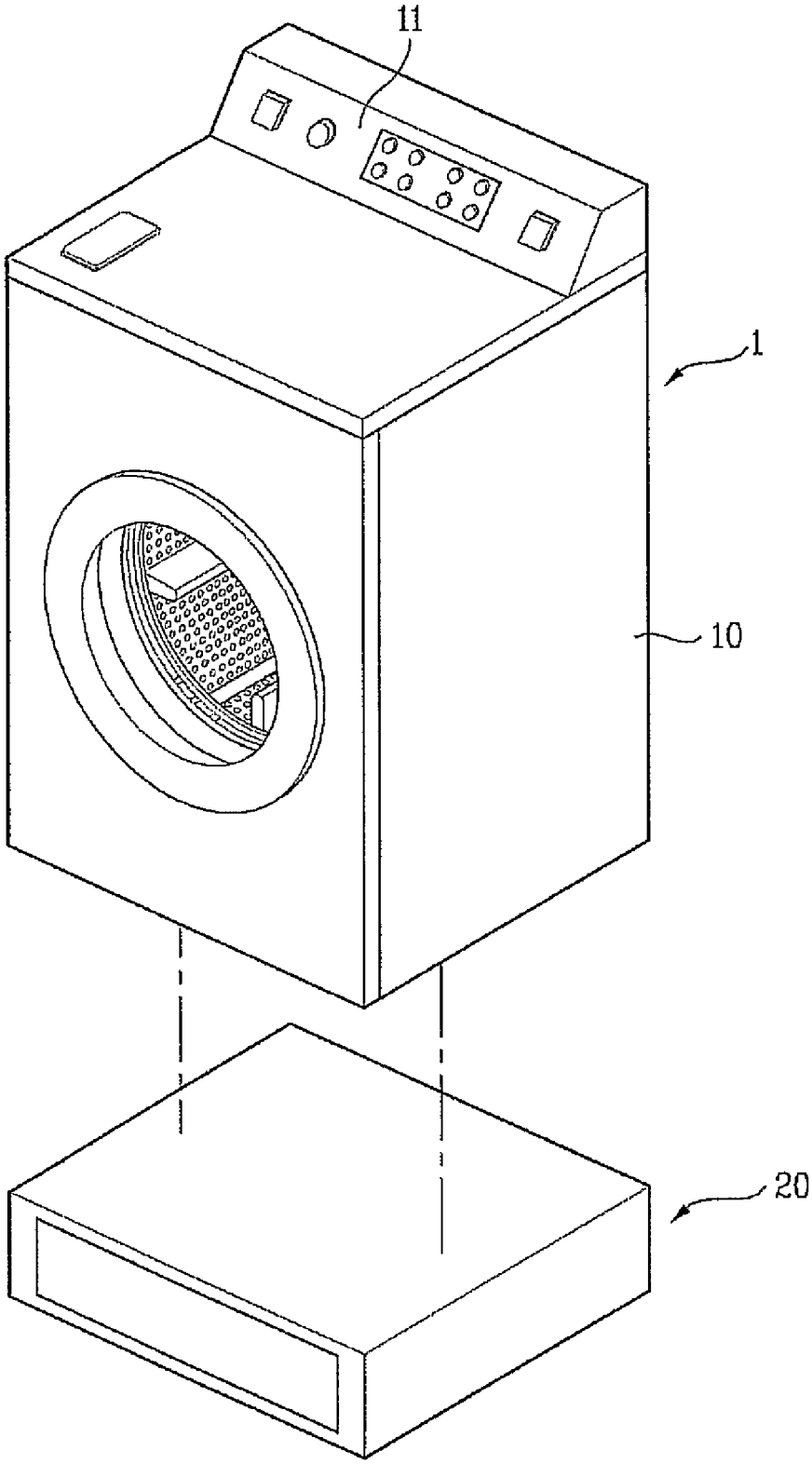

[Fig. 2]
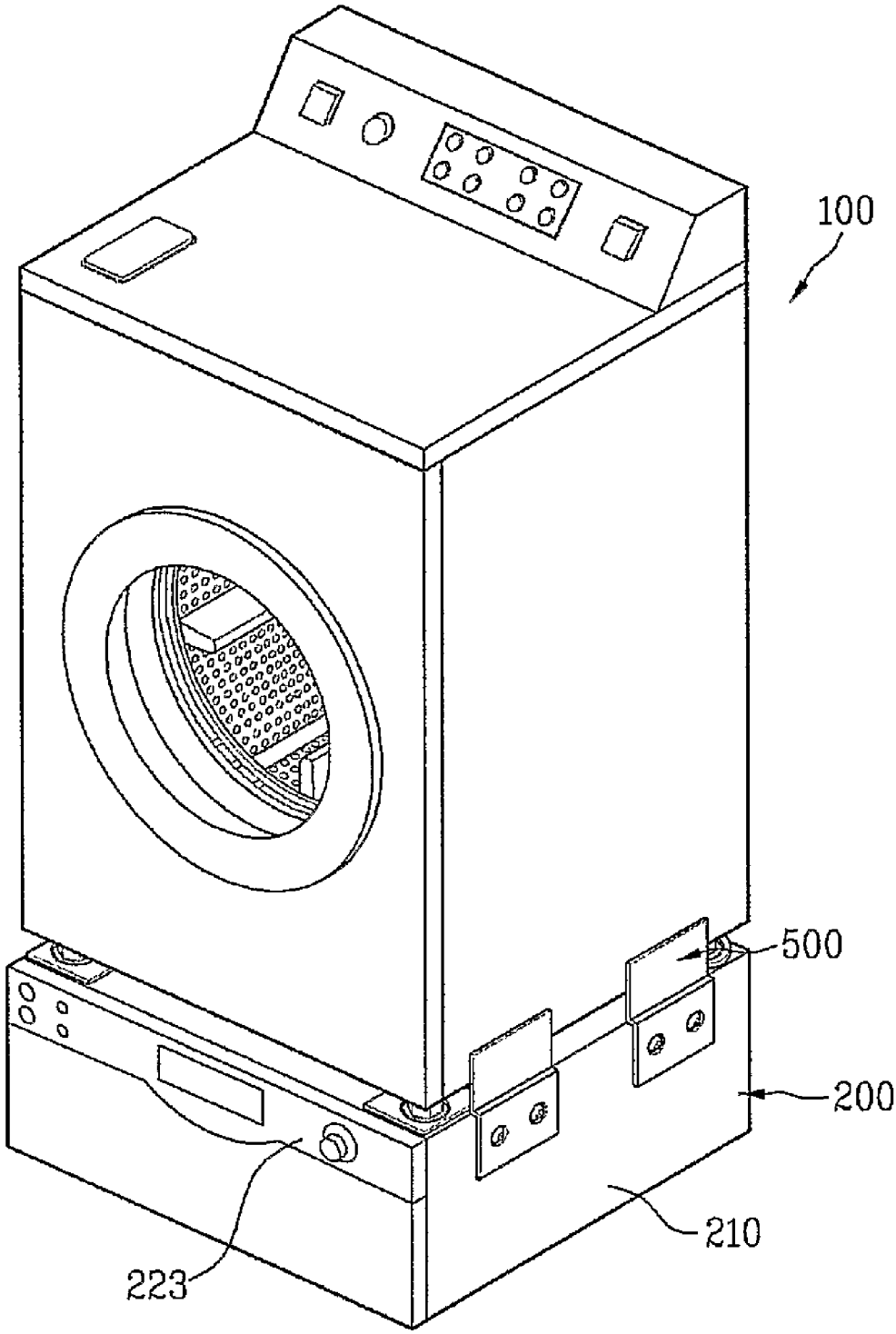

[Fig. 3]
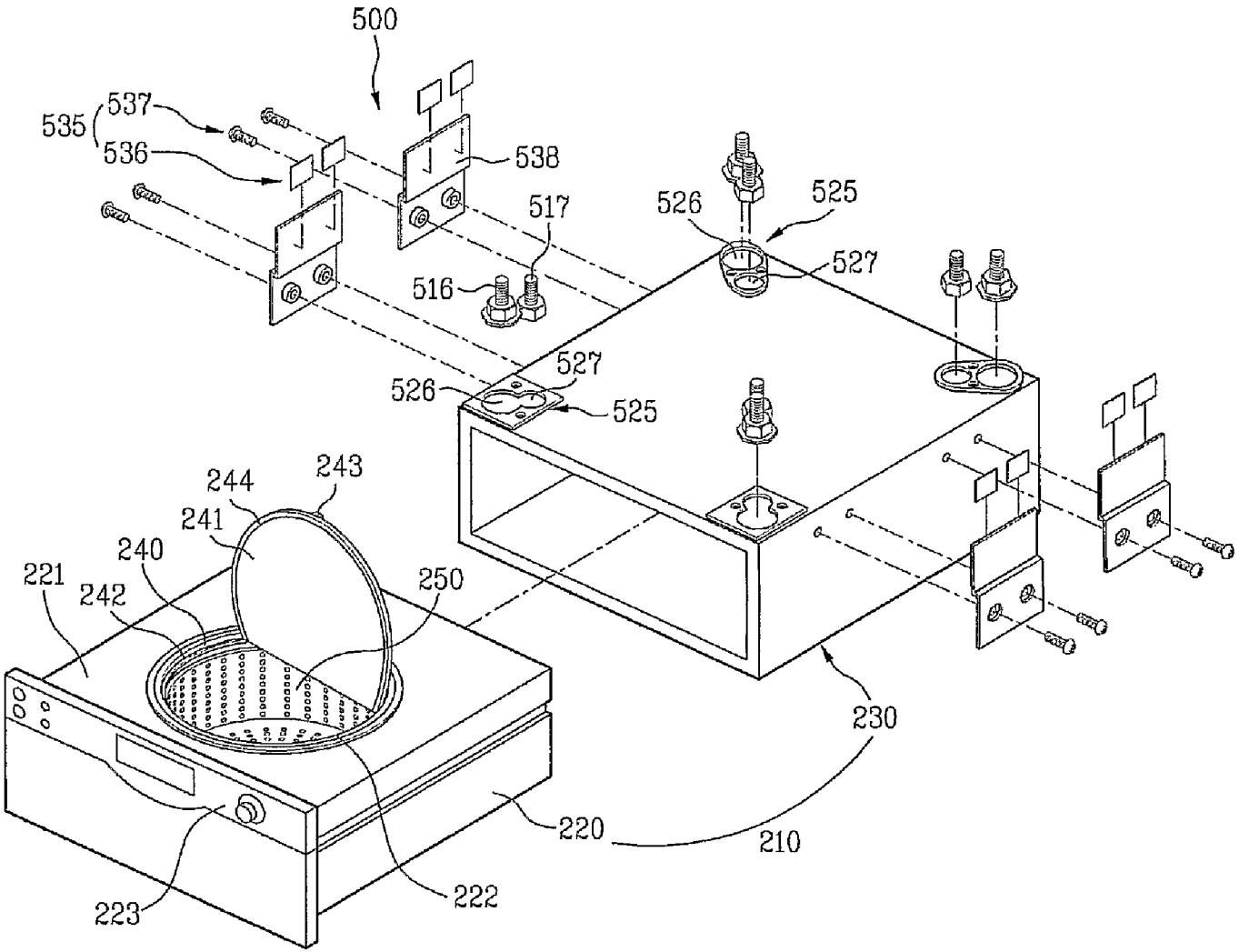

[Fig. 4]
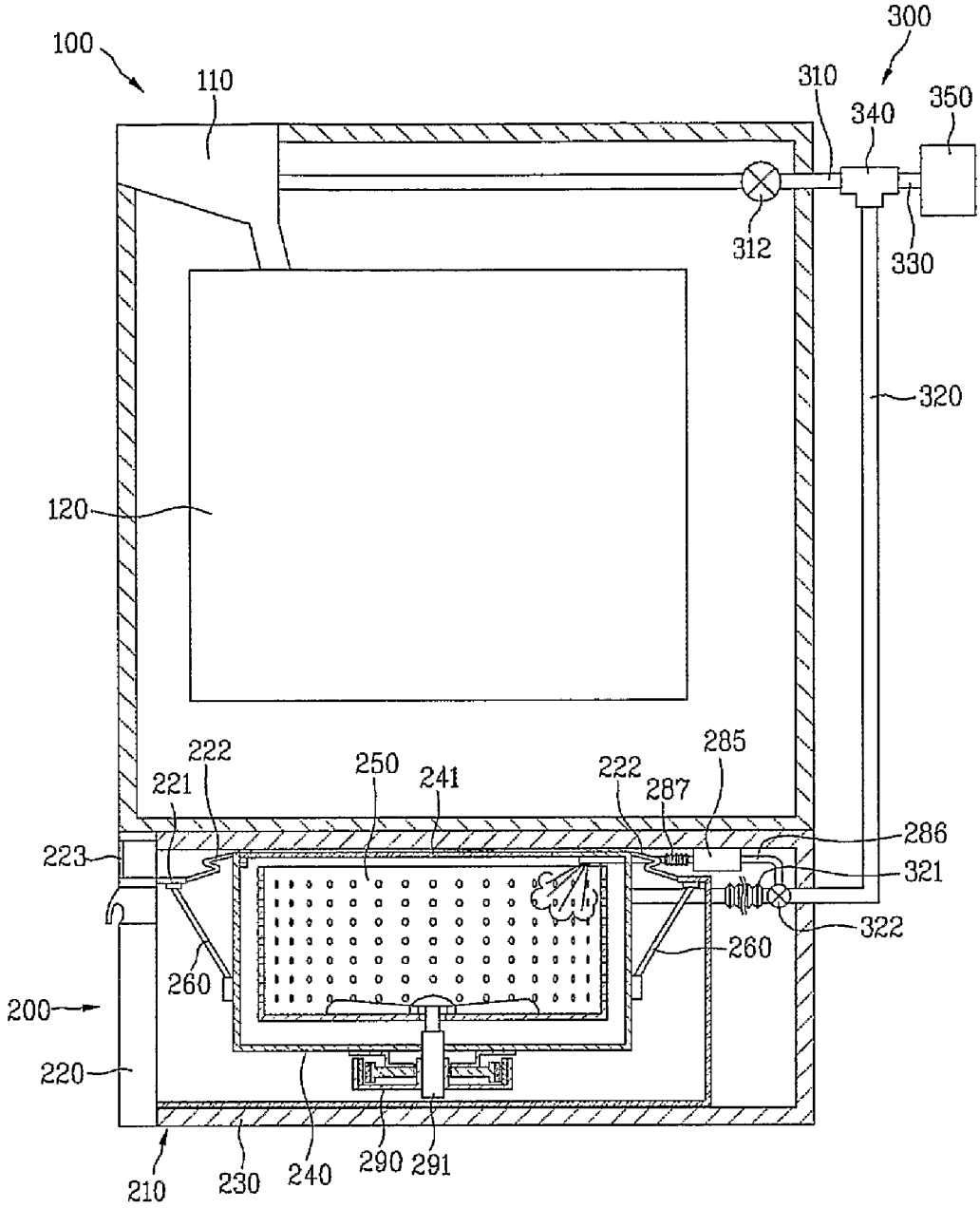

[Fig. 5]
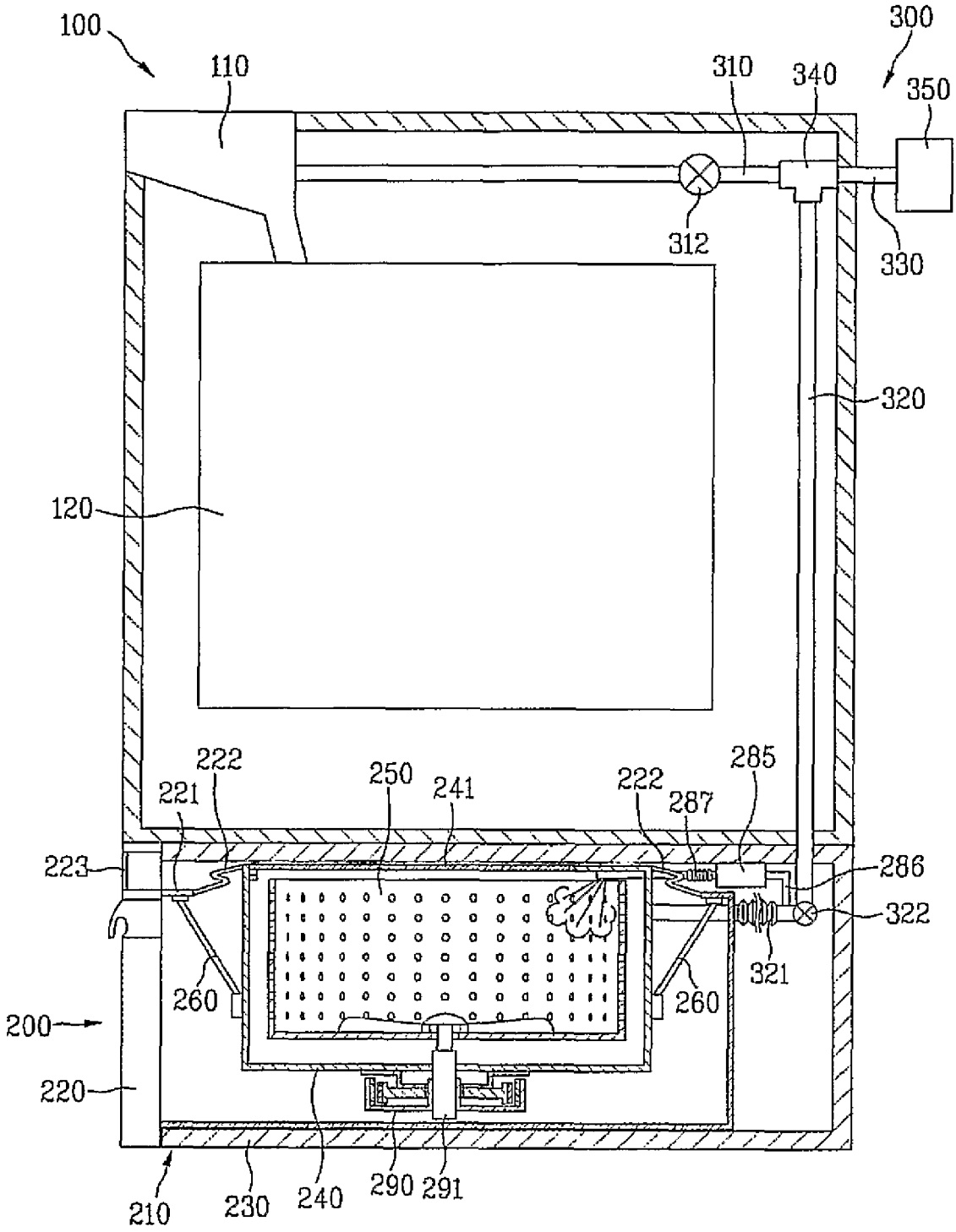

[Fig. 6]
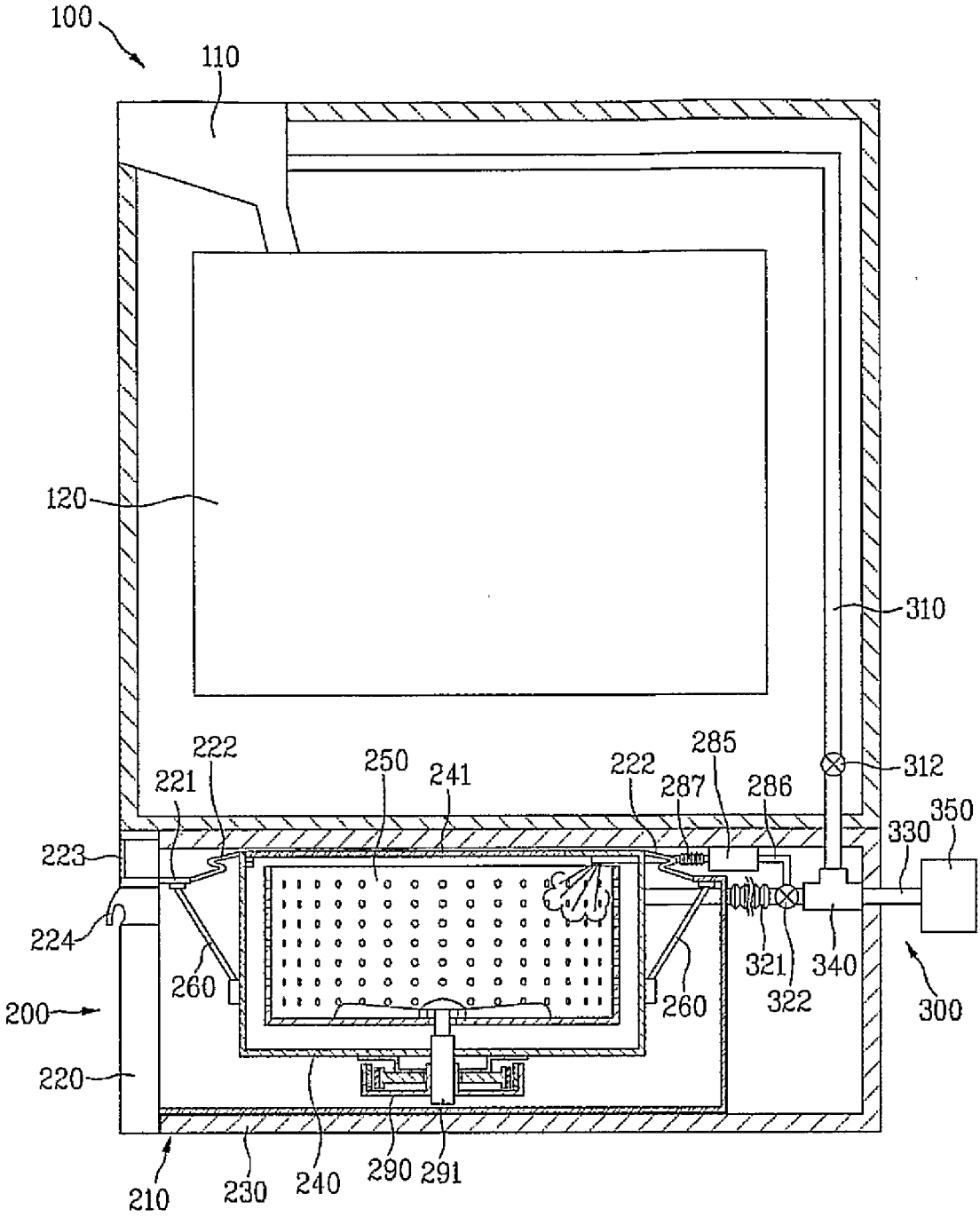

[Fig. 7]
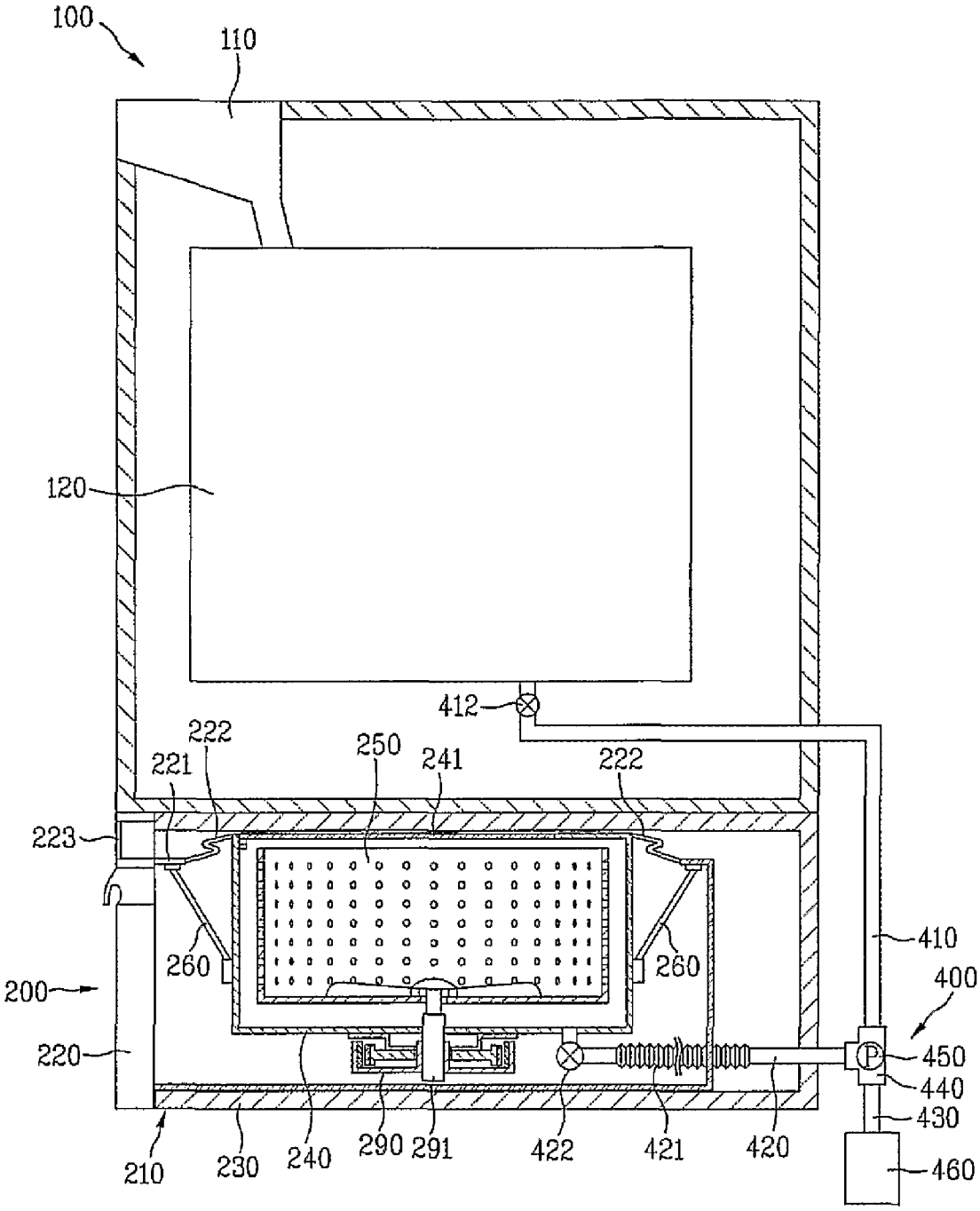

[Fig. 8]
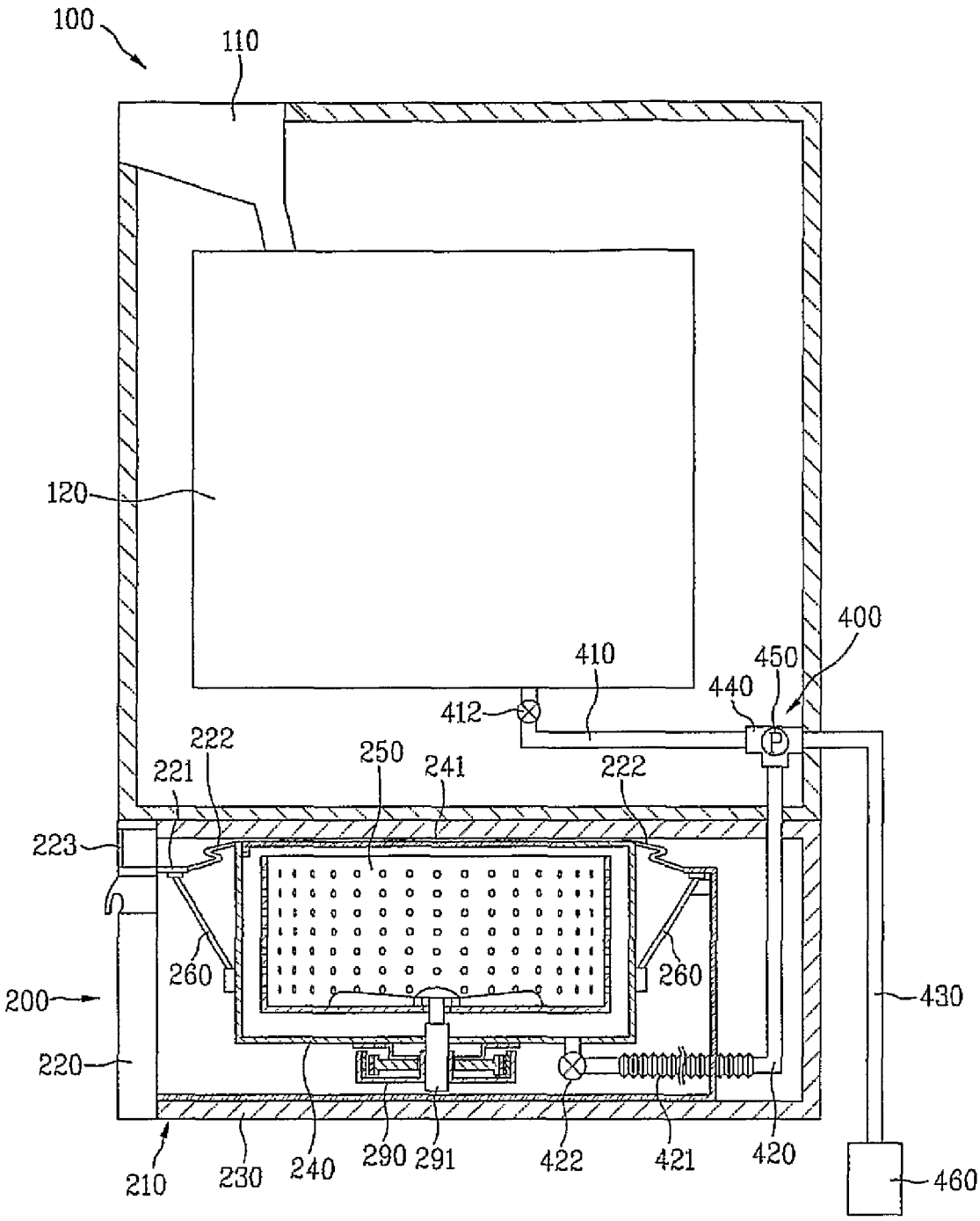

[Fig. 9]
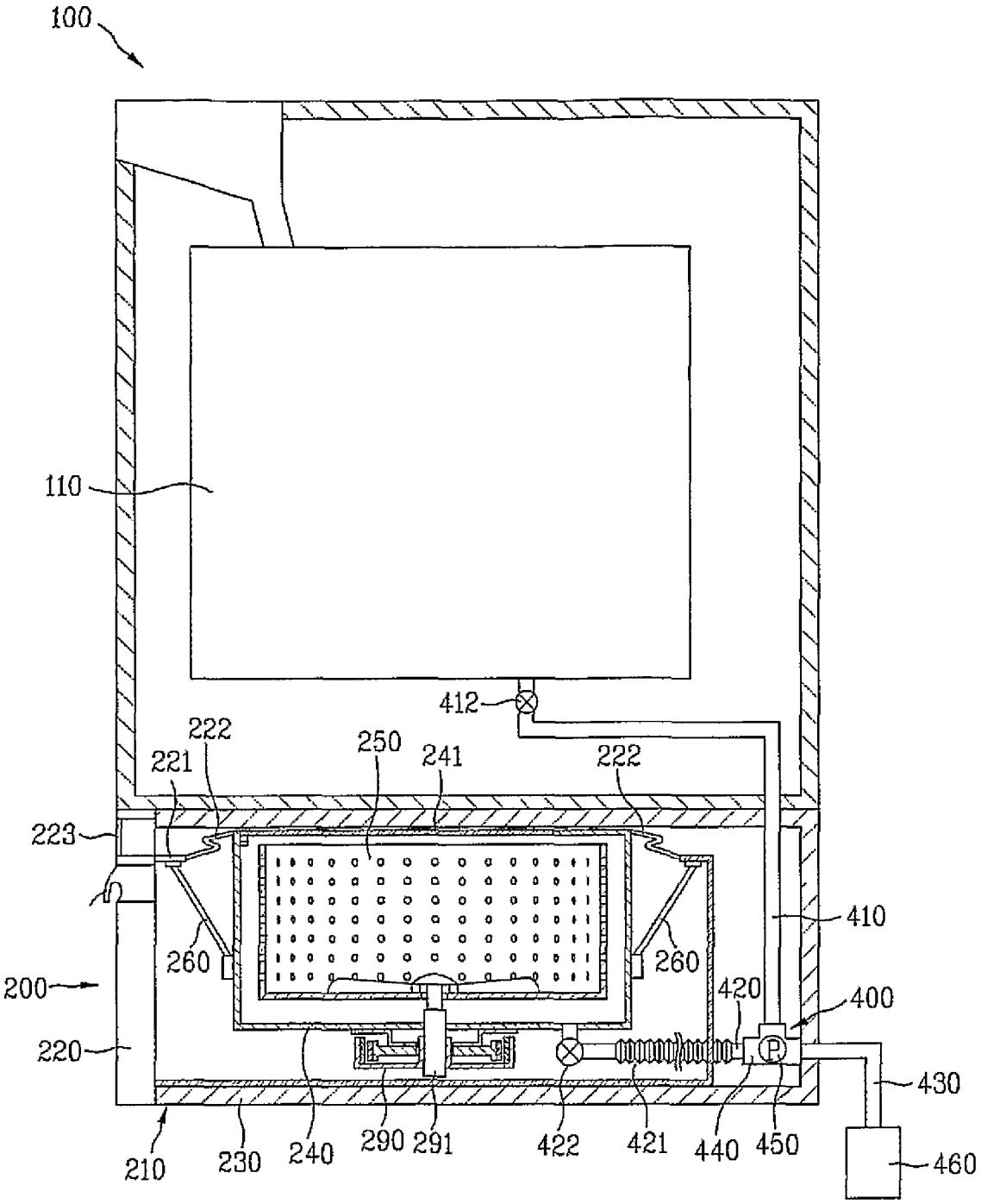

LAUNDRY DEVICE

TECHNICAL FIELD

The present invention relates to a laundry treating machine, and more particularly, to a laundry treating machine including a water supplier capable of simultaneously or selectively supplying water from a single external water supply source to a laundry treating device and a pedestal laundry treating device, and a water drainer capable of draining wash water discharged from the laundry treating device and pedestal laundry treating device through a single draining hole.

BACKGROUND ART

Generally, a laundry treating machine means an apparatus for washing, drying, or washing and drying laundry. One laundry treating machine can perform only a washing function or a drying function or can perform both the washing and drying functions. Recently, a laundry treating machine, which includes a steam supplier, to have a refresh function for, for example, removal of creases, odor, static electricity, etc. from laundry, has been available.

Meanwhile, conventional laundry treating machines are classified into a front loading type and a top loading type in accordance with the direction that laundry is taken cut. Also, conventional laundry treating machines are classified into a vertical-axis type, in which a pulsator or a washing tub rotates, and a horizontal-axis type, in which a drum rotates. The representative example of such a horizontal-axis type laundry treating machine is a drum washing machine or a drum drying machine.

Such laundry treating machines have a tendency to have a large size, in order to meet the recent demand of users. That is, laundry treating machines used for domestic purposes have a tendency to have a large outer size.

Generally, only one large-capacity washing machine is equipped in a home. When it is desired to wash different kinds of laundry in an independent manner, using the washing machine, it is necessary to operate the washing machine several times. For example, when it is desired to wash laundry such as adult clothes and laundry such as underclothes or baby clothes in an independent manner, the washing machine operates two times to individually wash the two different kinds of laundry. For this reason, the washing time increases, and the consumption of energy also increases.

Furthermore, it is undesirable to use the large-capacity washing machine in washing a small amount of laundry, in terms of saving of energy, as in conventional cases. This is because the washing course set in the large-capacity washing machine is typical for the case, in which the amount of laundry to be washed is large, so that the amount of water to be consumed in the washing course is large. Also, a large amount of electricity is consumed because it is necessary to rotate a large-size drum or pulsator. In additional, since the washing course set in the large-capacity washing machine is typical for the case, in which the amount of laundry to be washed is large, the washing time is relatively long.

Also, the washing course set in the large-capacity washing machine is typical for general clothes. For this reason, the large-capacity washing machine may be unsuitable for the washing of delicate clothes such as underclothes or baby clothes.

In addition, the large-capacity washing machine is unsuitable in the case in which washing of a small amount of laundry should be frequently performed. Generally, users collect laundry for several days, in order to wash the collected laundry at one time.

However, leaving laundry, in particular, underclothes or baby clothes, without immediately washing them, is undesirable in terms of cleanliness. Furthermore, when such clothes are left for a long period of time, there is a problem in that they cannot be cleanly washed because dirt may be fixed to the clothes.

In this regard, it is necessary to use a small-size washing machine having a capacity much smaller than the conventional large-capacity washing machine. However, where two small-size washing machines are equipped in a home, and they are laterally arranged in parallel, there are problems associated with space utility and beauty, even though the size of the washing machines is small.

FIG. 1 is a perspective view illustrating a conventional laundry treating machine.

As shown in FIG. 1, the conventional laundry treating machine 1 includes a body 10 forming the outer structure of the laundry treating machine 1, and a control panel 11 arranged at the front surface or top surface of the body 10. The control panel 11 may include a controller for controlling the operation of the laundry treating machine 1. In accordance with this configuration, the user enables the laundry treating machine 1 to perform a laundry treating operation such as a washing operation or a drying operation by manipulating the control panel 11.

The laundry treating machine 1 may be a washing machine, a drying machine, or a washing/drying machine.

The laundry treating machine 1 may further include a pedestal 20 for supporting the body 10 on a floor. In this case, the body 10 is laid on the pedestal 20.

In the conventional laundry treating machine, however, the pedestal 20 does not have any function other than the function to support the washing machine or drying machine.

DISCLOSURE OF INVENTION

Technical Problem

The present invention has been made in view of the above-mentioned problems, and an object of the present invention is to provide a laundry treating machine including a laundry treating device such as a drying machine or a washing machine, and a pedestal laundry treating device capable of not only treating a small amount of laundry without driving the laundry treating device, but also functioning as a pedestal for the laundry treating device.

Another object of the present invention is to provide a laundry treating machine configured to supply water from a single external water supply source to a laundry treating device and a pedestal laundry treating device, which are equipped in the laundry treating machine, in a simultaneous or selective manner in accordance with the simultaneous or selective operation of the laundry treating device and pedestal laundry treating device.

Still another object of the present invention is to provide a laundry treating machine including a laundry treating device, and a pedestal laundry treating device having a draining pipe joined with a draining pipe of the laundry treating device, to achieve drainage through a single draining hole, and to share a draining pump with the laundry treating device.

Technical Solution

In one aspect of the present invention, a laundry treating machine comprises: a laundry treating device; a pedestal laundry treating device arranged beneath and outside the laundry treating device, to support the laundry treating device, the pedestal laundry treating device having a volume and a height respectively smaller than a volume and a height of the laundry treating device, and having a laundry treating function; and a water supplier for simultaneously or selectively supplying water from a single external water supply source to the laundry treating device and the pedestal laundry treating device.

The pedestal laundry treating device may comprise an outer tub, and a case supporting the outer tub and including a drawer movable forwardly from the case.

The pedestal laundry treating device may further comprise a top frame covering at least a portion of a top of the drawer. The top frame may be integrated with the outer tub.

The water supplier may comprise a water supply pipe connected to the external water supply source, a first branched water supply pipe branched from the water supply pipe, to supply water to the laundry treating device, and a second branched water supply pipe branched from the water supply pipe, to supply water to the pedestal laundry treating device. The water supplier may further comprise a branching unit for branching the water supply pipe into the first and second branched water supply pipes. The branching unit may be arranged outside the laundry treating machine or in the laundry treating device.

The second branched water supply pipe may have at least a portion arranged in the laundry treating device.

The second branched water supply pipe may further has a portion arranged in the pedestal laundry treating device, and connected to the portion arranged in the laundry treating device. The branching unit, which branches the water supply pipe into the first and second branched water supply pipes, may be arranged in the pedestal laundry treating device.

The first branched water supply pipe may have at least a portion arranged in the pedestal laundry treating device. The first branched water supply pipe may further have a portion arranged in the laundry treating device, and connected to the portion arranged in the pedestal laundry treating device.

The water supplier may further comprises a first water supply valve for selectively opening and closing the first branched water supply pipe, and a second water supply valve for selectively opening and closing the second branched water supply pipe.

At least a portion of the second branched water supply pipe may comprise a water supply tube variable in length.

The laundry treating machine may further comprise a coupler for fixedly coupling the pedestal laundry treating device to the laundry treating device, to enable the pedestal laundry treating device to support the laundry treating device.

In another aspect of the present invention, a laundry treating machine comprises: a laundry treating device; a pedestal laundry treating device arranged beneath and outside the laundry treating device, to support the laundry treating device, the pedestal laundry treating device having a volume and a height respectively smaller than a volume and a height of the laundry treating device, and having a laundry treating function; and a water drainer for joining wash water discharged from the laundry treating device and wash water discharged from the pedestal laundry treating device into a single draining pipe, and draining the joined wash water.

The pedestal laundry treating device may comprise an outer tub, and a drawer supporting the outer tub. The drawer may be movable forwardly. The pedestal laundry treating device may further comprise a top frame covering at least a portion of a top of the drawer. The top frame may be integrated with the outer tub.

The water drainer may comprise a first water discharge pipe for discharging wash water from the laundry treating device, a second water discharge pipe for discharging wash water from the pedestal laundry treating device, and a draining pipe for joining the wash water discharged from the laundry treating device and the wash water discharged from the pedestal laundry treating device, and draining the joined wash water.

The water drainer may further comprises a joining unit for joining the first water discharge pipe and the second water discharge pipe into the draining pipe. The joining unit may be arranged outside the laundry treating machine or in the laundry treating device.

The second water discharge pipe may have at least a portion arranged in the laundry treating device.

The second water discharge pipe may further have a portion arranged in the pedestal laundry treating device, and connected to the portion arranged in the laundry treating device.

The joining unit, which joins the first water discharge pipe and the second water discharge pipe into the draining pipe, may be arranged in the pedestal laundry treating device. The first water discharge pipe may have at least a portion arranged in the pedestal laundry treating device.

The first water discharge pipe may further have a portion arranged in the laundry treating device, and connected to the portion arranged in the pedestal laundry treating device. The water drainer may further comprise a first draining valve for selectively opening and closing the first water discharge pipe, and a second draining valve for selectively opening and closing the second water discharge pipe.

The water drainer may further comprise a draining pump arranged at the draining pipe such that the first and second water discharge pipes share the draining pump with each other, to forcibly drain the wash water discharged from the laundry treating device and the wash water discharged from the pedestal laundry treating device.

Advantageous Effects

Since the laundry treating machine according to the present invention includes the pedestal laundry treating device, in addition to the laundry treating device, which has a relatively-large capacity, it is possible to treat a small amount of laundry without driving the large-capacity laundry treating device, and thus to save energy. Since the pedestal laundry treating device can also function as a pedestal for the large-capacity laundry treating device, which may be a drying machine or a washing machine, it is possible to achieve an enhancement in space utility.

Also, since the branched water supply pipe for the large-capacity laundry treating device and the branched water supply pipe for the pedestal laundry treating device are joined, it is possible to simultaneously or selectively supply water from a single water supply source to the large-capacity laundry treating device and pedestal laundry treating device.

In addition, since the water discharge pipe for the large-capacity laundry treating device and the water discharge pipe for the pedestal laundry treating device are joined, it is possible to simultaneously or selectively drain wash water discharged from the large-capacity laundry treating device and wash water discharged from the pedestal laundry treating device through a single draining hole.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 1 is a perspective view illustrating a conventional laundry treating machine;

FIG. 2 is a perspective view illustrating a laundry treating machine including a pedestal laundry treating device according to the present invention;

FIG. 3 is an exploded perspective view of the pedestal laundry treating device according to the present invention;

FIG. 4 is a sectional view simply illustrating a laundry treating machine including a water supplier according to an exemplary embodiment of the present invention;

FIG. 5 is a sectional view simply illustrating a laundry treating machine including a water supplier according to another embodiment of the present invention;

FIG. 6 is a sectional view simply illustrating a laundry treating machine including a water supplier according to another embodiment of the present invention;

FIG. 7 is a sectional view simply illustrating a laundry treating machine including a water drainer according to an exemplary embodiment of the present invention;

FIG. 8 is a sectional view simply illustrating a laundry treating machine including a water drainer according to another embodiment of the present invention; and FIG. 9 is a sectional view simply illustrating a laundry treating machine including a water drainer according to another embodiment of the present invention.

BEST MODE FOR CARRYING OUT THE INVENTION

The present invention now will be described more fully hereinafter with reference to the accompanying drawings, in which preferred embodiments of the invention are shown.

First, a pedestal laundry treating device according to an exemplary embodiment of the present invention will be described in detail with reference to FIGS. 2 to 6.

As shown in FIG. 2, the pedestal laundry treating device 200 functions as a pedestal for a laundry treating device 100, which may be a washing machine or a drying machine.

As shown in FIGS. 2 and 3, the pedestal laundry treating device 200 includes a case 210, in which a space to contain laundry is defined, and a coupler 500 to couple the case 210 with the laundry treating device 100. In this case, the pedestal laundry treating device 200 supports the laundry treating device 100 on a floor.

The pedestal laundry treating device 200 may further include leg supporters 525 provided at the top of the pedestal laundry treating device 200, to support side surfaces of lower legs 516 or 517 mounted to the bottom of the laundry treating device 100.

Each leg supporter 525 comprises a panel formed with first and second seating holes 526 and 527 for providing seats for one leg 516 and one leg 517, respectively. Each leg supporter 525 is mounted to the top of the pedestal laundry treating device case 210 by means of screws.

The leg supporters 525 are fixed to respective corners of the top of the pedestal laundry treating device case 210. In each of the leg supporters 525 fixed to the front corners of the case 210, the first and second seating holes 516 and 517 are connected to each other, different from the leg supporters 525 fixed to the rear corners of the case 210. In accordance with this structure, it is possible to easily achieve the seating of the legs 516 and 517.

The coupler 500 includes coupling members 538 each mounted to a side surface of the laundry treating device 100 and a side surface of the pedestal laundry treating device case 210, and fixing members 535 for fixing each coupling member 538 to both the associated side surface of the laundry treating device 100 and the associated side surface of the pedestal laundry treating device case 210.

As shown in FIG. 3, the coupler 538 may include at least two coupling members 538 each coupling the adjacent side surfaces of the pedestal laundry treating device case 210 and laundry treating device 100, each of which has a hexahedral shape.

In addition to the above-described configuration, the coupler 500 may further include a third coupling member (not shown) for coupling the rear surfaces of the pedestal laundry treating device case 210 and laundry treating device 100.

The coupler 500 may be configured to cope with a variation in the height of the legs 516 and 517.

Each fixing member 535 includes a first fixing member 536 for fixing an upper portion of the associated coupling member 538 to a lower portion of the side surface of the laundry treating device 100, to which the coupling member 138 is mounted, and a second fixing member 537 for fixing a lower portion of the coupling member 538 to an upper portion of the side surface of the pedestal laundry treating device 200, to which the coupling member 538 is mounted.

At least one of the first and second fixing members 536 and 537 may comprise a member coated, at opposite surfaces thereof, with an adhesive material, for example, a double-sided tape.

Alternatively, at least one of the first and second fixing members 536 and 537 may comprise a fastener such as a screw.

Where screws are used for each fixing member 535, the associated coupling member 538 preferably has fastening holes formed through the upper portion of the coupling member 538 while being spaced apart from each other by a certain distance.

Of course, the coupler for coupling the laundry treating device 100 and the pedestal laundry treating device case 210 may have various configurations different from the above-described configuration.

It is preferred that at least one of the lateral and longitudinal widths of the pedestal laundry treating device case 210 be equal to or longer than that of the laundry treating device 100, taking into consideration the stability and appearance design of the laundry treating machine.

Hereinafter, the configuration of the pedestal laundry treating device of the present invention will be described in detail with reference to FIGS. 4 to 6.

Referring to FIGS. 4 to 6, the pedestal laundry treating device 200 includes the case 210, in which a space to contain laundry is defined, as described above.

The case 210 includes a case body 230 and a drawer 220. The drawer 220 can be forwardly drawn from the case body 230.

The case body 230 has an appropriate size and a rigid structure, in order to enable a general laundry treating machine to be laid on the case body 230. To this end, the case body 230 preferably has a volume and a height smaller than those of the laundry treating device 100.

An outer tub 240 is installed in the drawer 220 such that the outer tub 240 is supported by the drawer 220. In detail, the outer tub 240 is supported by supporters 260 provided at the case body 230. Each supporter 260 is connected, at one end thereof, to an associated corner of a top frame 221 covering the top of the drawer 220. Each supporter 260 is also connected, at the other end thereof, to a side wall of the outer tub 240.

The outer tub 240 is connected, at the top thereof, with the top frame 221 via a gasket 222, which is a flexible sealer. The top frame 221 and gasket 222 prevent water and foreign matter from penetrating into a space defined between the outer tub 240 and the drawer 220.

An outer tub door 241 is mounted to the top of the outer tub 240 around an opening defined through the top of the outer tub 240. Since the pedestal laundry treating device 200 has a relatively low height, wash water may fly away from the outer tub 240. The outer tub door 241 prevents such a phenomenon.

A hook 243 is provided at the outer tub door 241. The hook 243 can be engaged in a hook groove (not shown) formed at an inner wall surface of the outer tub 240, to lock the outer tub door 241.

An inner tub 250 is arranged in the outer tub 240. A plurality of through holes are formed through the inner tub 250, to enable wash water to enter or exit the inner tub 250 through the through holes.

A motor 290 is fixedly mounted to a lower surface of the bottom of the outer tub 240. The motor 290 includes a stator fixedly mounted to the lower surface of the bottom of the outer tub 240. The motor 290 also includes a rotating shaft 291 extending through the bottom of the outer tub 240. The rotating shaft 291 is directly connected to the bottom of the inner tub 250. A bearing may be mounted to the bottom of the outer tub 240, to support the rotating shaft 291.

A control panel 223 is arranged on the front surface of the drawer 220. The control panel 223 includes various buttons and knobs for an input unit to input commands associated with a laundry treating operation, for example, a washing course. The control panel 223 also includes liquid crystal display (LCD) windows and a light emitting diode (LED) lamps for a display unit to display information as to a laundry treating operation. A main controller to control the pedestal laundry treating device 200 is also provided at the control panel 223.

A locker (not shown) may additionally be provided to maintain the drawer 220 in a state of being inserted into the case body 230. Preferably, the locker comprises an electronic locker which can be controlled by the main controller.

Since the configuration of the laundry treating device 100 according to the present invention is well known in a skilled person in the technical field to which the present invention pertains, no detained description thereof will be given.

Hereinafter, a water supplier, which is included in the laundry treating machine, will be described in detail with reference to FIGS. 4 to 6.

FIG. 4 is a sectional view illustrating a water supplier included in the laundry treating machine in accordance with an exemplary embodiment of the present invention.

As shown in FIG. 4, the laundry treating machine, which includes the laundry treating device 100, and the pedestal laundry treating device 200 adapted to perform a laundry treating operation for a small amount of laundry, etc., further includes a water supplier 300 to supply water to the laundry treating machine.

The water supplier 300 is configured to simultaneously or selectively supply water from a single external water supply source 350 to the laundry treating device 100 and pedestal laundry treating device 200. That is, the water supplier 300 includes a water supply pipe 330 connected to the external water supply source 350, a first branched water supply pipe 310 branched from the water supply pipe 330, to supply water to the laundry treating device 100, and a second branched water supply pipe 320 branched from the water supply pipe 330, to supply water to the pedestal laundry treating device 200.

The water supplier 300 also includes a branching unit 340 for branching the water supply pipe 330 extending from the external water supply source 350 into the first and second branched water supply pipes 310 and 320. The branching unit 340 is arranged outside the laundry treating machine.

Preferably, the branching unit 340 comprises an elbow pipe fitting capable of connecting the water supply pipe 330, first branched water supply pipe 310, and second branched water supply pipe 320.

In accordance with this configuration, the water supply pipe 330 is connected, at one end thereof, to the external water supply source 350, and is connected, at the other end thereof, to the branching unit 340.

The first branched water supply pipe 310 is connected, at one end thereof, to the branching unit 340, and is connected, at the other end thereof, to a laundry treating space 120 defined in the laundry treating device 100 such that the first branched water supply pipe 310 communicates with the laundry treating space 120.

Preferably, the end of the first branched water supply pipe 310 connected to the interior of the laundry treating device 100 is connected to a detergent box 110 arranged in the laundry treating device 100, to achieve the supply of water through the detergent box 110. Thus, a detergent contained in the detergent box 110 is introduced into the laundry treating space 120, simultaneously with the supply of water.

The second branched water supply pipe 320 is connected, at one end thereof, to the branching unit 340, and is connected, at the other end thereof, to an upper portion of the outer tub 240 in the pedestal laundry treating device 200 such that the second branched water supply pipe 320 communicates with the upper portion of the outer tub 240.

A portion of the second branched water supply pipe 320 comprises a bellows tube 321 extendable and contractable in a longitudinal direction. Accordingly, the bellows tube 321 extends when the drawer 220 is forwardly drawn. Instead of the bellows tube 321, a telescopic structure may be used.

The first branched water supply pipe 310 is provided with a first water supply valve 312 for the laundry treating device 100, whereas the second branched water supply pipe 320 is provided with a second water supply valve 322 for the pedestal laundry treating device 200. Accordingly, it is possible to simultaneously or selectively supply water from the single external water supply source 350 to the laundry treating device 100 and pedestal laundry treating device 200.

A steam generator 285 is also provided to supply steam to the outer tub 240. The steam generator 285 is connected to the second water supply valve 322 via a water supply pipe 286, to receive water. Steam generated from the steam generator 285 is supplied to the interior of the outer tub 240 via a steam supply pipe 287. The steam supply pipe 287 has a length-variable structure such as a bellows tube. The steam supply pipe 287 has a steam spray port, which is preferably arranged at an upper portion of the inner tub 250, in order to supply steam to the inner tub 250.

The steam generator 285 may have the same structure as the steam generator used in conventional laundry treating machines.

FIG. 5 is a sectional view illustrating a water supplier included in the laundry treating machine in accordance with another embodiment of the present invention.

In the water supplier according to this embodiment, the branching unit 340, which branches the water supply pipe 330 into the first and second branched water supply pipes 310 and 320, is arranged in the laundry treating device 100.

In accordance with this embodiment, the water supply pipe 330 is connected, at one end thereof, to the external water supply source 350, and is connected, at the other end thereof, to the branching unit 340.

The first branched water supply pipe 310 for the laundry treating device 100 is connected, at one end thereof, to the branching unit 340 in the laundry treating device 100, and is connected, at the other end thereof, to the laundry treating space 120.

Preferably, the end of the first branched water supply pipe 310 connected to the interior of the laundry treating device 100 is connected to a detergent box 110 arranged in the laundry treating device 100, to achieve the supply of water through the detergent box 110. Thus, a detergent contained in the detergent box 110 is introduced into the laundry treating space 120, simultaneously with the supply of water.

The second branched water supply pipe 320 for the pedestal laundry treating device 200 is connected, at one end thereof, to the branching unit 340, and is connected, at the other end thereof, to an upper portion of the outer tub 240 in the pedestal laundry treating device 200. In this case, the second branched water supply pipe 320 includes a portion arranged in the laundry treating device 100, and a portion arranged in the pedestal laundry treating device 200, and connected to the portion arranged in the laundry treating device 100.

The portion of the second water supply pipe 320 arranged in the pedestal laundry treating device 200 comprises a bellows tube 321 extendable and contractable in a longitudinal direction. Accordingly, the bellows tube 321 extends when the drawer 220 is forwardly drawn. Instead of the bellows tube 321, a telescopic structure may be used.

The first branched water supply pipe 310 is provided with a first water supply valve 312 for the laundry treating device 100, whereas the second branched water supply pipe 320 is provided with a second water supply valve 322 for the pedestal laundry treating device 200. Accordingly, it is possible to simultaneously or selectively supply water from the single external water supply source 350 to the laundry treating device 100 and pedestal laundry treating device 200.

Alternatively, the first and second water supply valves 320 and 330 may be arranged in the branching unit 340, in order to control the supply of water at the side of the branching unit 340. In this case, a single water supply valve may be used.

FIG. 6 is a sectional view illustrating a water supplier included in the laundry treating machine in accordance with another embodiment of the present invention.

In the water supplier according to this embodiment, the branching unit 340, which branches the water supply pipe 330 into the first and second branched water supply pipes 310 and 320, is arranged in the pedestal laundry treating device 200. Accordingly, the water supply pipe 330 is connected, at one end thereof, to the external water supply source 350, and is connected, at the other end thereof, to the branching unit 340 arranged in the pedestal laundry treating device 200.

The first branched water supply pipe 310 for the laundry treating device 100 is connected, at one end thereof, to the branching unit 340 in the pedestal laundry treating device 200, and is connected, at the other end thereof, to the laundry treating space 120. In this case, the first branched water supply pipe 310 includes a portion arranged in the laundry treating device 100, and a portion arranged in the pedestal laundry treating device 200, and connected to the portion arranged in the laundry treating device 100.

Preferably, the end of the first branched water supply pipe 310 arranged in the laundry treating device 100 is connected to a detergent box 110 arranged in the laundry treating device 100, to achieve the supply of water through the detergent box 110. Thus, a detergent contained in the detergent box 110 is introduced into the laundry treating space 120, simultaneously with the supply of water.

The second branched water supply pipe 320 for the pedestal laundry treating device 200 is connected, at one end thereof, to the branching unit 340, and is connected, at the other end thereof, to an upper portion of the outer tub 240 in the pedestal laundry treating device 200.

A portion of the second water supply pipe 320 comprises a bellows tube 321 extendable and contractable in a longitudinal direction. Accordingly, the bellows tube 321 extends when the drawer 220 is forwardly drawn. Instead of the bellows tube 321, a telescopic structure may be used.

The first branched water supply pipe 310 is provided with a first water supply valve 312 for the laundry treating device 100, whereas the second branched water supply pipe 320 is provided with a second water supply valve 322 for the pedestal laundry treating device 200. Accordingly, it is possible to simultaneously or selectively supply water from the single external water supply source 350 to the laundry treating device 100 and pedestal laundry treating device 200.

Alternatively, the first and second water supply valves 320 and 330 may be arranged in the branching unit 340, in order to control the supply of water at the side of the branching unit 340. In this case, a single water supply valve may be used.

Hereinafter, a water drainer, which is included in the laundry treating machine, will be described in detail.

FIG. 7 is a sectional view illustrating a water drainer included in the laundry treating machine in accordance with an exemplary embodiment of the present invention.

As shown in FIG. 7, the laundry treating machine, which includes the laundry treating device 100, and the pedestal laundry treating device 200 adapted to perform a laundry treating operation for a small amount of laundry, etc., further includes a water drainer 400 to drain wash water from the laundry treating device 100 and pedestal laundry treating device 200.

The water drainer 400 joins wash water discharged from the laundry treating device 100 and wash water discharged from the pedestal laundry treating device 200 into a single draining pipe, in order to simultaneously or selectively achieve the draining operation of the laundry treating device 100 and the draining operation of the pedestal laundry treating device 200.

That is, the water drainer 400 includes a first water discharge pipe 410 for discharging wash water from the laundry treating device 100, a second water discharge pipe 420 for discharging wash water from the pedestal laundry treating device 200, and a draining pipe 430 for joining the wash water discharged from the laundry treating device 100 and the wash water discharged from the pedestal laundry treating device 200, and draining the joined wash water. The draining pipe 430 is connected, at one end thereof, to a draining hole 460.

The water drainer 400 also includes a joining unit 440 for joining the wash water discharged from the laundry treating device 100 and the wash water discharged from the pedestal laundry treating device 200, and draining the joined water flow. The joining unit 440 is arranged outside the laundry treating machine.

Preferably, the joining unit 440 comprises an elbow pipe fitting capable of connecting the first water discharge pipe 410, second water discharge pipe 420, and draining pipe 430. In accordance with this configuration, the first water discharge pipe 410 for the laundry treating device 100 is connected, at one end thereof, to a lower portion of the laundry treating space 120 of the laundry treating device 100, and is connected, at the other end thereof, to the joining unit 440.

The second water discharge pipe 420 is connected, at one end thereof, to the lower portion of the outer tub 240 in the pedestal laundry treating device 200, and is connected, at the other end thereof, to the joining unit 440.

A portion of the second water discharge pipe 420 comprises a bellows tube 421 extendable and contractable in a longitudinal direction. Accordingly, the bellows tube 421 extends when the drawer 220 is forwardly drawn. Instead of the bellows tube 421, a telescopic structure may be used.

The draining pipe 430 is connected, at one end thereof, to the joining unit 440, and is connected, at the other end thereof, to the draining hole 460, in order to drain wash water discharged from the first water discharge pipe 410 and wash water discharged from the second water discharge pipe 420 through the draining hole 460.

The first water discharge pipe 410 is provided with a first water discharge valve 412 for the laundry treating device 100, whereas the second water discharge pipe 420 is provided with a second water discharge valve 422 for the pedestal laundry treating device 200. Accordingly, it is possible to simultaneously or selectively drain wash water discharged from the laundry treating device 100 and wash water discharged from the pedestal laundry treating device 200. When only one of the laundry treating device 100 and pedestal laundry treating device 200 performs a draining operation, the first and second water discharge valves 412 and 422 also function to prevent wash water discharged from the laundry treating device performing the draining operation from flowing backwardly to the other laundry treating device.

The water drainer 400 further includes a draining pump 450 arranged at the draining pipe 430 or joining unit 440, to forcibly drain wash water discharged from the laundry treating device 100 and wash water discharged from the pedestal laundry treating device 200. In accordance with this configuration, the laundry treating device 100 and pedestal laundry treating device 200 share the draining pump 450 with each other.

Of course, draining pumps may be arranged at the laundry treating device 100 and pedestal laundry treating device 200, respectively.

FIG. 8 is a sectional view illustrating a water drainer included in the laundry treating machine in accordance with another embodiment of the present invention.

In the water drainer according to this embodiment, the joining unit 440, which joins wash water discharged from the laundry treating device 100 and wash water discharged from the pedestal laundry treating device 200, and drains the joined water flow into the draining pipe 430, is arranged in the laundry treating device 100.

In this case, the first water discharge pipe 410 for the laundry treating device 100 is connected, at one end thereof, to the lower portion of the laundry treating space 120 of the laundry treating device 100, and is connected, at the other end thereof, to the joining unit 440 arranged in the laundry treating device 100.

The second water discharge pipe 420 for the pedestal laundry treating device 200 is connected, at one end thereof, to the lower portion of the outer tub 240 in the pedestal laundry treating device 200, and is connected, at the other end thereof, to the joining unit 440 arranged in the laundry treating device 100. In this case, the second water discharge pipe 420 includes a portion arranged in the laundry treating device 100, and a portion arranged in the pedestal laundry treating device 200, and connected to the portion arranged in the laundry treating device 100.

The portion of the second water discharge pipe 420 arranged in the pedestal laundry treating device 200 comprises a bellows tube 421 extendable and contractable in a longitudinal direction. Accordingly, the bellows tube 421 extends when the drawer 220 is forwardly drawn. Instead of the bellows tube 321, a telescopic structure may be used.

The draining pipe 430 is connected, at one end thereof, to the joining unit 440 arranged in the laundry treating device 100, and is connected, at the other end thereof, to the draining hole 460, in order to join wash water discharged from the first water discharge pipe 410 and wash water discharged from the second water discharge pipe 420, and to drain the joined wash water through the draining hole 460.

The first water discharge pipe 410 is provided with a first water discharge valve 412 for the laundry treating device 100, whereas the second water discharge pipe 420 is provided with a second water discharge valve 422 for the pedestal laundry treating device 200. Accordingly, it is possible to simultaneously or selectively drain wash water discharged from the laundry treating device 100 and wash water discharged from the pedestal laundry treating device 200. When only one of the laundry treating device 100 and pedestal laundry treating device 200 performs a draining operation, the first and second water discharge valves 412 and 422 also function to prevent wash water discharged from the laundry treating device performing the draining operation from flowing backwardly to the other laundry treating device.

The water drainer 400 further includes a draining pump 450 arranged at the draining pipe 430 or joining unit 440, to forcibly drain wash water discharged from the laundry treating device 100 and wash water discharged from the pedestal laundry treating device 200. In accordance with this configuration, the laundry treating device 100 and pedestal laundry treating device 200 share the draining pump 450.

FIG. 9 is a sectional view illustrating a water drainer included in the laundry treating machine in accordance with another embodiment of the present invention.

In the water drainer according to this embodiment, the joining unit 440, which joins wash water discharged from the laundry treating device 100 and wash water discharged from the pedestal laundry treating device 200, and drains the joined water flow into the draining pipe 430, is arranged in the pedestal laundry treating device 200.

In accordance with this embodiment, the first water discharge pipe 410 for the laundry treating device 100 is connected, at one end thereof, to the lower portion of the laundry treating space 120 of the laundry treating device 100, and is connected, at the other end thereof, to the joining unit 440 arranged in the pedestal laundry treating device 200. In this case, the first water discharge pipe 410 includes a portion arranged in the laundry treating device 100, and a portion arranged in the pedestal laundry treating device 200, and connected to the portion arranged in the laundry treating device 100.

The second water discharge pipe 420 for the pedestal laundry treating device 200 is connected, at one end thereof, to the lower portion of the outer tub 240 in the pedestal laundry treating device 200, and is connected, at the other end thereof, to the joining unit 440.

The portion of the second water discharge pipe 420 arranged in the pedestal laundry treating device 200 comprises a bellows tube 421 extendable and contractable in a longitudinal direction. Accordingly, the bellows tube 421 extends when the drawer 220 is forwardly drawn. Instead of the bellows tube 321, a telescopic structure may be used.

The draining pipe 430 is connected, at one end thereof, to the joining unit 440 arranged in the pedestal laundry treating device 200, and is connected, at the other end thereof, to the draining hole 460, in order to join wash water discharged from the laundry treating device 100 and wash water discharged from the pedestal laundry treating device 200, and to drain the joined wash water through the draining hole 460.

The first water discharge pipe 410 is provided with a first water discharge valve 412 for the laundry treating device 100, whereas the second water discharge pipe 420 is provided with a second water discharge valve 422 for the pedestal laundry treating device 200. Accordingly, it is possible to simultaneously or selectively drain wash water discharged from the laundry treating device 100 and wash water discharged from the pedestal laundry treating device 200. When only one of the laundry treating device 100 and pedestal laundry treating device 200 performs a draining operation, the first and second water discharge valves 412 and 422 also function to prevent wash water discharged from the laundry treating device performing the draining operation from flowing backwardly to the other laundry treating device.

The water drainer 400 further includes a draining pump 450 arranged at the draining pipe 430 or joining unit 440, to forcibly drain wash water discharged from the laundry treating device 100 and wash water discharged from the pedestal laundry treating device 200. In accordance with this configuration, the laundry treating device 100 and pedestal laundry treating device 200 share the draining pump 450.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

Since the laundry treating machine according to the present invention includes a pedestal laundry treating device, in addition to a laundry treating device having a relatively-large capacity, it is possible to treat a small amount of laundry without driving the large-capacity laundry treating device, and thus to save energy. Since the pedestal laundry treating device can also function as a pedestal for the large-capacity laundry treating device, which may be a drying machine or a washing machine, it is possible to achieve an enhancement in space utility.

When the pedestal laundry treating device is used, simultaneously with the large-capacity laundry treating device, different kinds of laundry can be simultaneously treated in an independent manner.

Also, since the branched water supply pipe for the large-capacity laundry treating device and the branched water supply pipe for the pedestal laundry treating device are joined, it is possible to simultaneously or selectively supply water from a single water supply source to the large-capacity laundry treating device and pedestal laundry treating device.

In addition, since the water discharge pipe for the large-capacity laundry treating device and the water discharge pipe for the pedestal laundry treating device are joined, it is possible to simultaneously or selectively drain wash water discharged from the large-capacity laundry treating device and wash water discharged from the pedestal laundry treating device through a single draining hole.

The invention claimed is:

1. A laundry treating machine comprising:

a laundry treating device;

a pedestal laundry treating device having a laundry treating function, the pedestal laundry treating device having a forwardly movable drawer; and a water supplier for simultaneously or selectively supplying water from a single external water supply source to the laundry treating device and the pedestal laundry treating device, wherein the water supplier comprises a water supply pipe connected to the external water supply source, a first branched water supply pipe supplying water to the laundry treating device and a second branched water supply pipe supplying water to the pedestal laundry treating device, and at least a portion of the second branched water supply pipe is extendable.

2. The laundry treating machine according to claim 1, wherein the pedestal laundry treating device comprises an outer tub and a case supporting the outer tub, the drawer being movable forwardly from the case.

3. The laundry treating machine according to claim 2, wherein the pedestal laundry treating device further comprises a top frame covering at least a portion of a top of the drawer, the top frame being integrated with the outer tub.

4. The laundry treating machine according to claim 1, wherein the water supplier further comprises a branching unit for branching the water supply pipe into the first and second branched water supply pipes, the branching unit being arranged outside the laundry treating machine.

5. The laundry treating machine according to claim 1, wherein the water supplier further comprises a branching unit for branching the water supply pipe into the first and second branched water supply pipes, the branching unit being arranged in the laundry treating machine.

6. The laundry treating machine according to claim 5, wherein the second branched water supply pipe has at least a portion arranged in the laundry treating device.

7. The laundry treating machine according to claim 6, wherein the second branched water supply pipe further has a portion arranged in the pedestal laundry treating device, and connected to the portion arranged in the laundry treating device.

8. The laundry treating machine according to claim 1, wherein the water supplier further comprises a branching unit for branching the water supply pipe into the first and second branched water supply pipes, the branching unit being arranged in the pedestal laundry treating device.

9. The laundry treating machine according to claim 8, wherein the first branched water supply pipe has at least a portion arranged in the pedestal laundry treating device.

10. The laundry treating machine according to claim 9, wherein the first branched water supply pipe further has a portion arranged in the laundry treating device, and connected to the portion arranged in the pedestal laundry treating device.

11. The laundry treating machine according to claim 1, wherein the water supplier further comprises a first water supply valve for selectively opening and closing the first branched water supply pipe, and a second water supply valve for selectively opening and closing the second branched water supply pipe.

12. The laundry treating machine according to claim 1, wherein at least a portion of the second branched water supply pipe comprises a water supply tube variable in length.

13. The laundry treating machine according to claim 1, further comprising a coupler for fixedly coupling the pedestal laundry treating device to the laundry treating device, to enable the pedestal laundry treating device to support the laundry treating device.

14. The laundry treating machine according to claim 1, the laundry treating machine further comprises a water drainer for joining wash water discharged from the laundry treating device and wash water discharged from the pedestal laundry treating device into a single draining pipe, and draining the joined wash water.

15. The laundry treating machine according to claim 14, wherein the water drainer comprises a first water discharge pipe for discharging wash water from the laundry treating device, a second water discharge pipe for discharging wash water from the pedestal laundry treating device, and a draining pipe for joining the wash water discharged from the laundry treating device and the wash water discharged from the pedestal laundry treating device, and draining the joined wash water.

16. The laundry treating machine according to claim 15, wherein the water drainer further comprises a joining unit for joining the first water discharge pipe and the second water discharge pipe into the draining pipe, the joining unit being arranged outside the laundry treating machine.

17. The laundry treating machine according to claim 15, wherein the water drainer further comprises a joining unit for joining the first water discharge pipe and the second water discharge pipe into the draining pipe, the joining unit being arranged in the laundry treating device.

18. The laundry treating machine according to claim 17, wherein the second water discharge pipe has at least a portion arranged in the laundry treating device.

19. The laundry treating machine according to claim 17, wherein the second water discharge pipe further has a portion arranged in the pedestal laundry treating device, and connected to the portion arranged in the laundry treating device.

* * * * *